United States Patent [19]

Nakashima

[11] Patent Number: 5,072,680

[45] Date of Patent: Dec. 17, 1991

[54] PATTERN STITCH SEWING MACHINE HAVING IMAGE PROJECTION MEANS

[75] Inventor: Akifumi Nakashima, Ichinomiya, Japan

[73] Assignee: Brother Kogyo Kabushiki Kaisha, Japan

[21] Appl. No.: 602,699

[22] Filed: Oct. 24, 1990

[30] Foreign Application Priority Data

Feb. 10, 1990 [JP] Japan ..... 2-31020

[51] Int. Cl.[5] ..... D05B 3/02

[52] U.S. Cl. ..... 112/445; 353/28

[58] Field of Search ..... 112/445, 453, 121.11, 112/121.12, 103, 266.1, 262.3; 353/28, 30, 35, 36

[56] References Cited

U.S. PATENT DOCUMENTS

| | | | |
|---|---|---|---|
| 3,683,779 | 8/1972 | Lifton | 353/35 X |
| 4,124,285 | 11/1978 | Johnson et al. | 353/28 |
| 4,270,473 | 6/1981 | Brienza | 112/445 |
| 4,341,170 | 7/1982 | Beckerman et al. | 112/445 X |
| 4,577,574 | 3/1986 | Takahashi | 112/445 |
| 4,960,061 | 10/1990 | Tajima et al. | 112/445 X |
| 4,998,489 | 3/1991 | Hisatake et al. | 112/103 |

FOREIGN PATENT DOCUMENTS

| | | | |
|---|---|---|---|
| 64-45865 | 2/1989 | Japan | 112/121.12 |

*Primary Examiner*—Peter Nerbun

*Attorney, Agent, or Firm*—Oliff & Berridge

[57] ABSTRACT

To aid in the proper placement of patterns to be sewn on work fabric, a sewing machine includes a pattern projection system for forming pattern images on the fabric. The pattern images are of the same size and orientation as the pattern sewn by the machine. The image projection system includes a light source and a light transmission imaging element for forming images on the fabric. The imaging element can be liquid crystal. The image forming system displays a marker to indicate that portions of the pattern to be sewn are outside a predetermined image area. A memory is provided to store pattern completion data, so that after an interruption in the sewing of a pattern, the unfinished part of the pattern can be imaged on the fabric and the machine can complete the pattern.

27 Claims, 7 Drawing Sheets

PATTERN STITCH SEWING MACHINE HAVING IMAGE PROJECTION MEANS

BACKGROUND OF THE INVENTION

1. Field of the Invention

The present invention relates to a sewing machine capable of forming a stitch pattern, and more particularly to a sewing machine having a pattern indicating function.

2. Discussion of the Related Art

Zigzag sewing machines capable of forming stitch patterns are generally known. Such zigzag sewing machines incorporate a needle bar having a needle, which is rocked at a desired angle, and give a desired feeding motion to a work fabric on a bed by a feed dog extending from a throat plate so as to be movable upward/downward and forward/backward, thereby sewing various stitch patterns, such as letters and figures. In recent zigzag sewing machines, a microcomputer is included in a control unit to electrically control the motions of the needle bar and the feed dog, so that many stitch patterns may be easily sewn. In the case of sewing stitch patterns such as alphabetical letters and edgings on the work fabric, data relating to these stitch patterns are preliminarily stored in a memory such as ROM in a control circuit, and the motions of the needle bar and the feed dog are given under control according to the pattern data selectively read from the memory by a microprocessor (CPU), thereby easily sewing the stitch patterns on the work fabric.

In this kind of a computer controlled sewing machine, a display device such as a liquid crystal display capable of displaying patterns is normally included so that an operator may directly visibly confirm what kinds of patterns are stored in the memory and which pattern has been selected.

In the case of selecting a desired pattern from the memory and sewing a stitch pattern corresponding to the selected pattern on the work fabric, the operator must decide a start position of sewing on the work fabric placed on the bed before starting the sewing. However, the decision of the start position of sewing is very hard especially for a beginner, and it is sometimes necessary for him to re-try the decision in the course of sewing. Thus, the decision of the start position of sewing is a bottleneck in the operation.

Some of the recent zigzag sewing machines which are commercially available include a mechanism for laterally feeding the feed dog, so as to sew a stitch pattern having a larger size. In association with this, it is frequently carried out, for example, to sew a large frame pattern on the work fabric and thereafter sew a letter indicative of a message. In this case, a sewing position of the letter must be precisely set so that the frame pattern previously sewn does not interfere with the letter to be sewn later. However, this operation is generally hard for the beginner, and it is often necessary for him to re-try the operation.

These inconveniences are caused by the fact that it is generally hard for the operator to perceive an actual size and direction of the stitch pattern corresponding to the selected pattern to be sewn on the work fabric and a start position of sewing of the stitch pattern on the work fabric. To cope with this problem, it is known to provide means for numerically displaying a width of oscillation of the needle, a length of a stitch, etc. on a liquid crystal display, so that the operator may perceive how largely the selected pattern is to be sewn as the stitch pattern.

However, even by numerically displaying the width of oscillation of the needle and the length of the stitch on the display, a sewing position of the stitch pattern on the work fabric cannot be precisely confirmed. Accordingly, in order to precisely sew the stitch pattern at a desired position, the operator must manually rotate a pulley of the sewing machine to confirm a position of needle location or carry out trial sewing. Thus, there still remains such a troublesome problem.

SUMMARY OF THE PRESENT INVENTION

It is an object of the present invention to provide a sewing machine which enables an operator to precisely confirm a sewing position of a stitch pattern before sewing is started.

To achieve the above object, there is provided a sewing machine including a vertically movable needle bar having a needle at the lower end thereof, and a memory storing data relating to various patterns, wherein the needle bar and a work fabric are relatively moved in directions crossing an axis of vertical movement of the needle according to the data read from the memory to sew the patterns on the work fabric; the improvement comprising means for imaging the data relating to the patterns selectively read from the memory, and means for projecting the patterns imaged by the imaging means onto a surface of a bed of the sewing machine or the work fabric on the bed, the patterns to be projected by the projecting means having the same size, direction and position as those of stitch patterns to be obtained after sewing.

According to the present invention, a pattern selected by an operator is projected on the surface of the bed or the work fabric placed on the bed with the same size, direction and position as those of a stitch pattern to be obtained after sewing. Accordingly, a sewing position of the stitch pattern can be precisely confirmed by the operator. Therefore, the work fabric can be easily set in an initial position even by a beginner to thereby reliably sew the stitch pattern at the desired position.

BRIEF DESCRIPTION OF THE DRAWINGS

A preferred embodiment of the present invention will be described in detail with reference to following figures wherein.

DETAILED DESCRIPTION OF THE PREFERRED EMBODIMENTS

An embodiment will be described in which the present invention is employed in a zigzag sewing machine.

Basic Structure of the Sewing Machine

Figure 1:
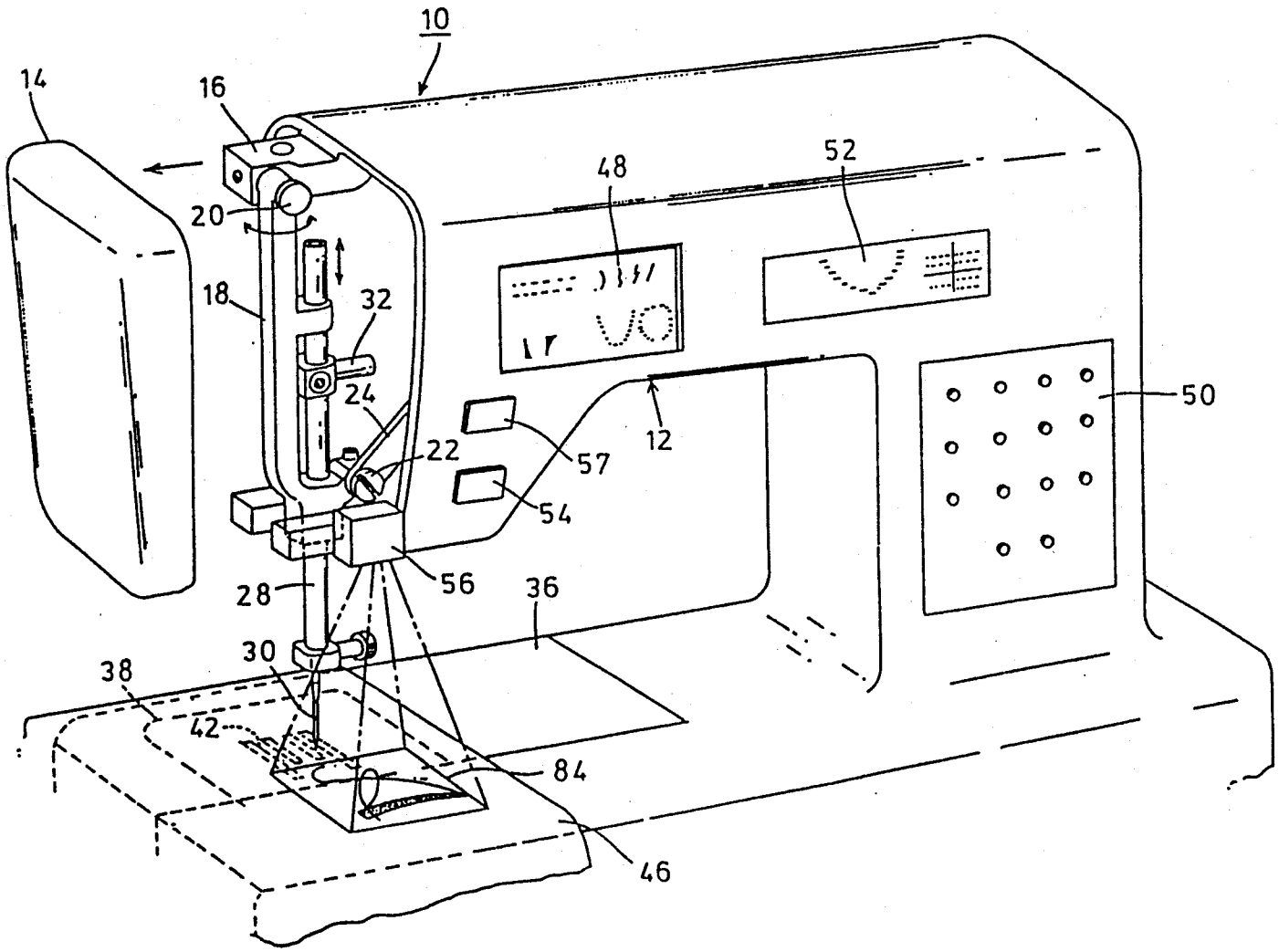
FIG. 1 is a perspective view of a general construction of a sewing machine according to a preferred embodiment of the present invention.

FIG. 1 is a perspective view of a general construction of the zigzag sewing machine according to the preferred embodiment, and it shows a condition where a cover 14 is removed from a head 12 of a sewing machine 10. A needle bar support 18 is pivotably supported at its upper end through a shaft 20 to a fixed projection 16 provided at the upper portion of the head 12, so that the needle bar support 18 may be rocked within a predetermined angle in a vertical plane. The lower end of the needle bar support 18 is connected through a shaft 22 to a connecting rod 24. The connecting rod 24 is connected to a needle rocking control motor 26 shown in FIG. 3, and is driven by the motor 26. Thus, a rocking motion of the needle bar support 18 within a predetermined angle is provided through the connecting rod 24 by driving the motor 26.

A needle bar 28 is supported on the needle bar support 18 so as to be slidably movable up and down relative thereto, and a needle 30 is fixed to the lower end of the needle bar 28. The needle bar 28 is connected through a needle bar connecting stud 32 mounted thereto and an arm shaft (not shown) to a machine motor 34 shown in FIG. 3. Thus, a vertical reciprocating motion of the needle bar 28 and the needle 30 is provided by driving the machine motor 34.

A throat plate 38 is provided on a bed 36 of the sewing machine 10. The throat plate 38 is formed with a plurality of slots arranged in rows. A feed dog 42 is aligned with the slots and is projectable upwardly. The feed dog 42 is connected through a fabric feeding mechanism (not shown) to a fabric feeding control motor 44 shown in FIG. 3. Thus, a feeding motion of the feed dog 42 in forward/backward, right/left, and upward/downward directions (with respect to an operator of the sewing machine) is provided by driving the motor 44. Further, although not shown, a presser foot is vertically movably provided just over the feed dog 42, so that a work fabric 46 placed on the bed 36 may be fed in forward/backward and right/left directions by the cooperation of the feed dog 42 and the presser foot.

Figure 2:
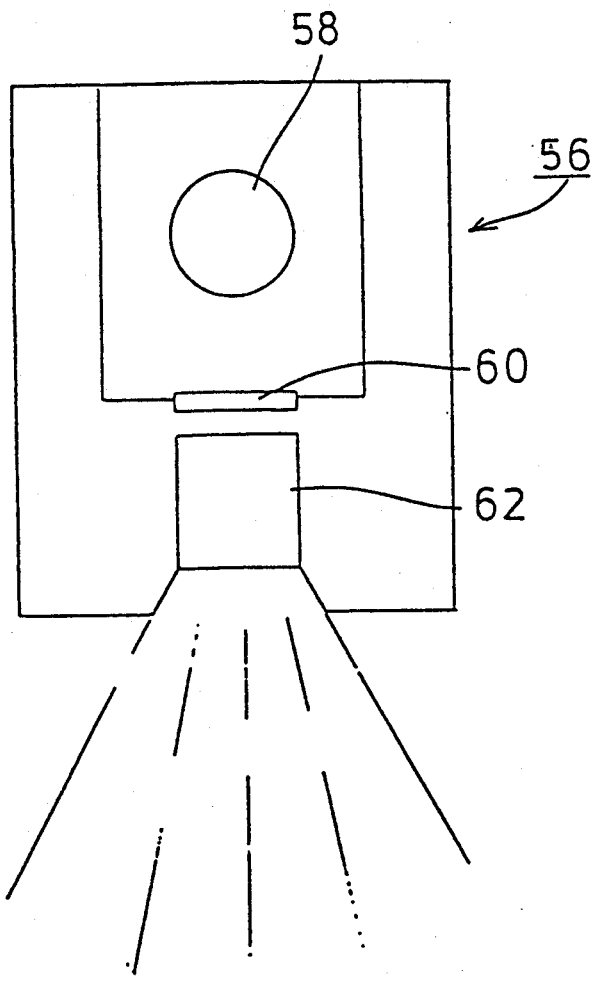
FIG. 2 is a schematic illustration of a projector to be used in the preferred embodiment.
Figure 3:
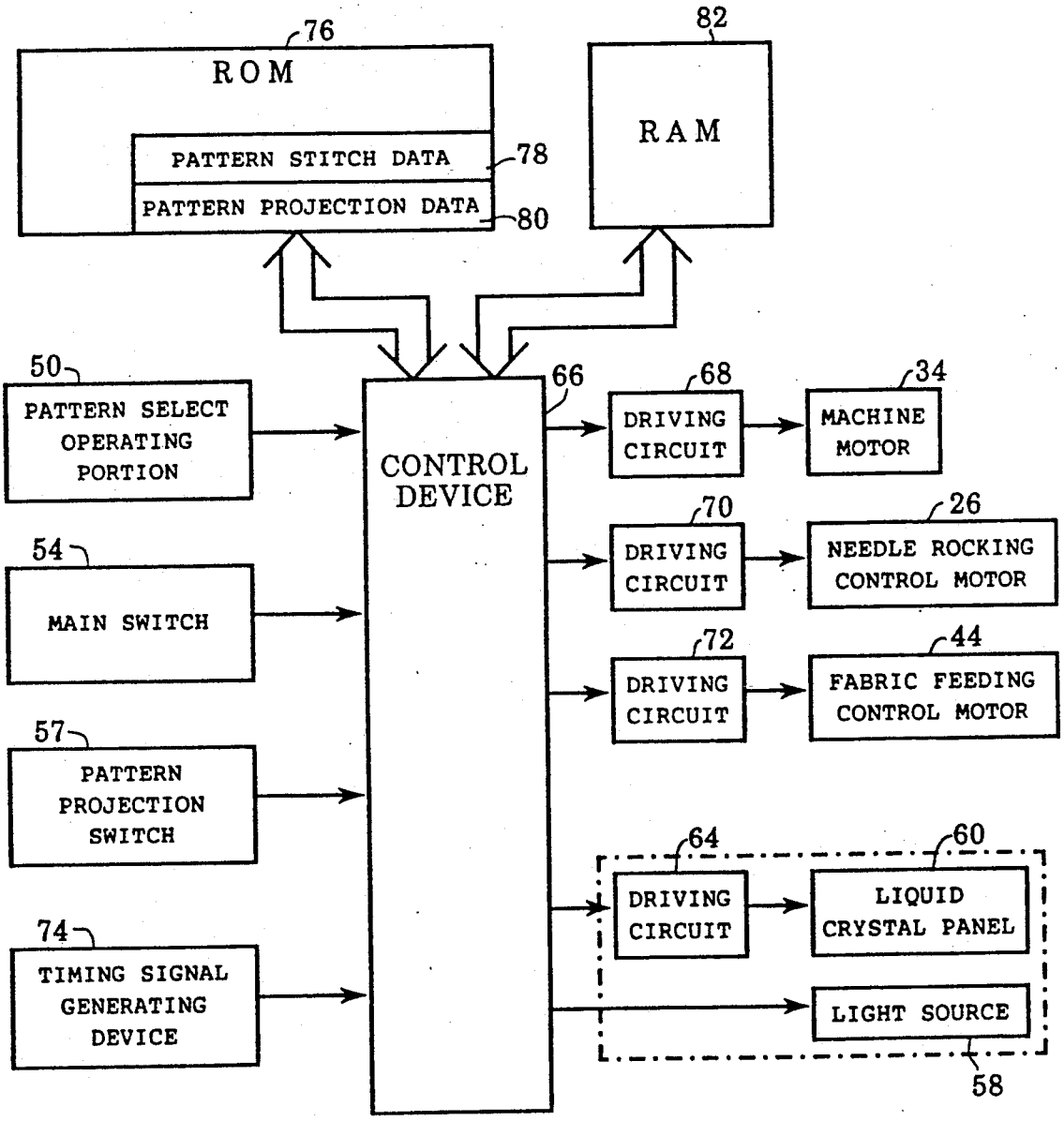
FIG. 3 is a block diagram of an electrical system for controlling operation members of the sewing machine according to the preferred embodiment.

A body of the sewing machine 10 is provided with a pattern display 48 for displaying patterns stored in ROM 76 shown in FIG. 3, a pattern select operating portion 50 including known operation switches for selecting a desired one of these patterns, and a selected pattern display 52 for displaying a selected pattern and pattern number. Further, the head 12 of the sewing machine 10 is provided with a main switch 54 for controlling start and stop of the machine motor 34. Projector A projector 56 capable of projecting various patterns such as characters and figures is provided at the lower portion of the head 12 on the front side of the needle bar 28 in relation to the operator. As shown in FIG. 2, the projector 56 is basically constructed of a light source 58, such as a metal halide discharge lamp, a liquid crystal panel 60 for imaging a pattern according to pattern projection data selectively read from the ROM 76, and an image forming lens 62 for optically image-forming the pattern of light transmitted through the liquid crystal panel 60. That is, the liquid crystal panel 60 is provided with a plurality of very small shutters, and the liquid crystal shutters are driven to open or close by a driving circuit 64 shown in FIG. 3 to thereby image the pattern. Systems for driving the liquid crystal to display stitch patterns are known, for example, to drive a confirmatory display on the machine. Similar systems can be used to drive liquid crystal panel 60.

Accordingly, by transmitting the light from the light source 58 through the liquid crystal panel 60 and the image forming lens 62, an imaged pattern is projected and formed at a focal position on a surface of the bed 36 or the work fabric 46 placed on the bed 36. The imaged pattern has the same size, direction and position as those of a stitch pattern to be obtained by sewing. Further, the head 12 is provided with a pattern projection switch 57, at a position adjacent to the main switch 54 for controlling of the projector 56.

Electrical Control System

FIG. 3 is a block diagram of an electrical control system for controlling the operation of the sewing machine according to the preferred embodiment. The main switch 54 is connected to a control device 66 basically composed of a microprocessor (CPU), and the control device 66 controls start/stop of the machine motor 34 through a driving circuit 68 according to machine start/stop operation signals to be generated by the operation of the main switch 54. Further, a driving circuit 70 for driving the needle rocking control motor 26 and a driving circuit 72 for driving the fabric feeding control motor 44 are also connected to the control device 66.

The ROM 76 as a memory device preliminarily stores pattern stitch data 78, pattern projection data 80, and area over mark data and a readable and writable RAM 82 temporarily stores a result computed in the control device 66, for example. A code signal corresponding to a selected pattern is supplied to the control device 66 by operating the pattern select operating portion 50. Further, the pattern projection switch 57 is connected to the control device 66, and the control device 66 generates a projection signal for turning on and off the light source 58 of the projector 56 according to the operation of the pattern projection switch 57. The liquid crystal panel 60 of the projector 56 is connected through the driving circuit 64 to the control device 66. Further, a timing signal generating device 74 generates a signal relating to operation timing of the needle rocking control motor 26, the machine motor 34 and the fabric feeding control motor 44.

Flow of the Control System

Figure 4:
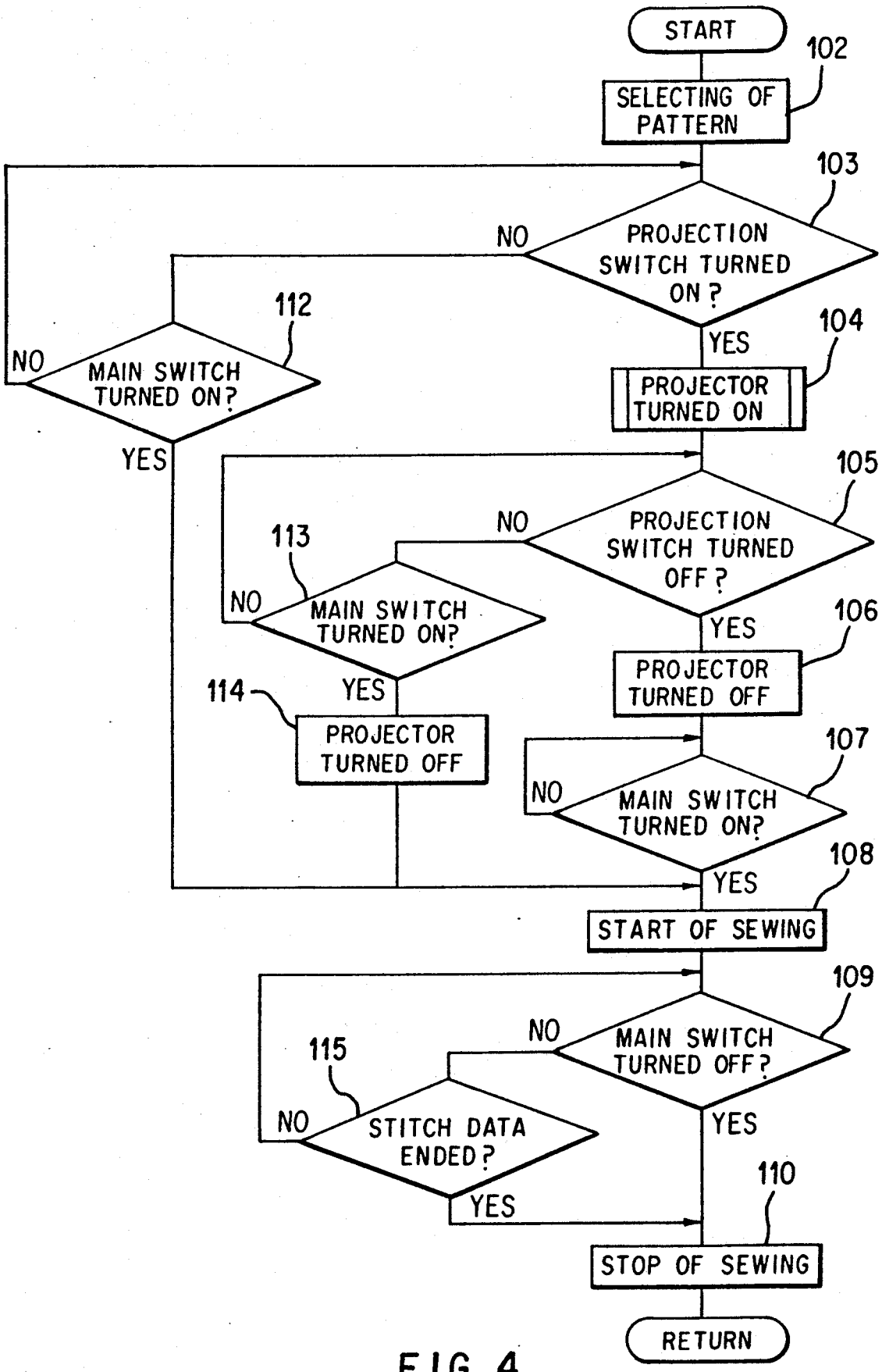
FIG. 4 is a flowchart showing the operation of the sewing machine according to the preferred embodiment.

In the sewing machine according to the preferred embodiment, an operation flow upon supplying of each signal to the control device 66 is shown in FIG. 4. In the preferred embodiment, the following conditions are basically defined. That is, (1) when the pattern projection switch 57 is turned on under a stop condition of the sewing machine 10, the projector 56 is turned on, and (2) when the pattern projection switch 57 is turned off or the main switch 54 is turned on to start driving the machine motor 34, the projector 56 is turned off.

After the preparation for sewing is completed, a desired pattern is selected from the various patterns stored in the ROM 76 by operating the pattern select operating portion 50 in step 102 ("step" will be hereinafter referred to as "S"). Then, it is determined in S103 whether or not the projection switch 57 is ON. If the answer is NO, it is determined in S112 whether or not the main switch 54 is ON. If the main switch 54 is not ON (i.e., the answer is NO), the program returns to S103, while if the main switch 54 is ON (i.e., the answer is YES), the program proceeds to S108. On the other hand, if the projection switch 57 is ON, the answer in S103 is YES, and the program proceeds to S104 in which the projector 56 is turned on. Accordingly, an imaged pattern having the same size, direction and position as those of a stitch pattern to be obtained after sewing is projected on the surface of the bed 36 or the work fabric 46 placed on the bed 36. A subroutine of projection processing by the projector 56 will be hereinafter described with reference to FIG. 5.

After the operator completes setting of the work fabric 46 at an initial position on the basis of the projected pattern formed on the surface of the bed 36 or the work fabric 46, the projector 56 becomes unnecessary, and it is accordingly turned off in accordance with the following procedure. That is, if the projection switch 57 is not OFF in S105 (i.e., the answer is NO), the program proceeds to S113, and if the main switch 54 is turned on in S113 (i.e., the answer is YES), the projector 56 is turned off in S114. If the main switch 54 is OFF in S113 (i.e., the answer is NO), the program returns to S105. Then, if the projection switch 57 is turned off in S105 (i.e., the answer is YES), the projector 56 is turned off in S106.

After the projector 56 is turned off in S106, it is awaited that the main switch 54 is turned on in S107. If the main switch 54 is turned on (i.e., the answer is YES), sewing of a stitch pattern is started in S108. Also in the case where the main switch 54 is turned on in S113, and the projector 56 is turned off in S114, the program proceeds to S108 in which sewing of the stitch pattern is started. When the sewing of the stitch pattern is started in S108, the stitch data 78 corresponding to the pattern selected by the pattern select operating portion 50 in S102 is read from the ROM 76. Then, the machine motor 34, the needle rocking control motor 26 and the fabric feeding control motor 44 are driven according to the stitch data 78 read from the ROM 76 and a timing signal to be supplied from the timing signal generating device 74 to sew the stitch pattern corresponding to the selected pattern on the work fabric.

Then, it is determined in S109 whether or not the main switch 64 is turned off. If the answer is NO, it is determined in S115 whether or not the sewing according to the stitch data 78 read from the ROM 76 is ended. If the sewing according to the stitch data 78 is not ended (i.e., the answer is NO), the sewing is continued. If the sewing according to the stitch data 78 is ended (i.e., the answer is YES), the driving of each motor 34, 26 and 44 is stopped in S110 to stop the sewing, and the program is returned. On the other hand, if the main switch 54 is turned off in S109, the program proceeds to S110 in which the sewing according to the stitch data 78 is interrupted. In this case, a stitch number data indicating what proportion of the stitch pattern is formed at the timing of interruption of the sewing is stored into the RAM 82, to prepare for restart of the sewing according to the stitch data.

Subroutine in the Projector

Figure 5:
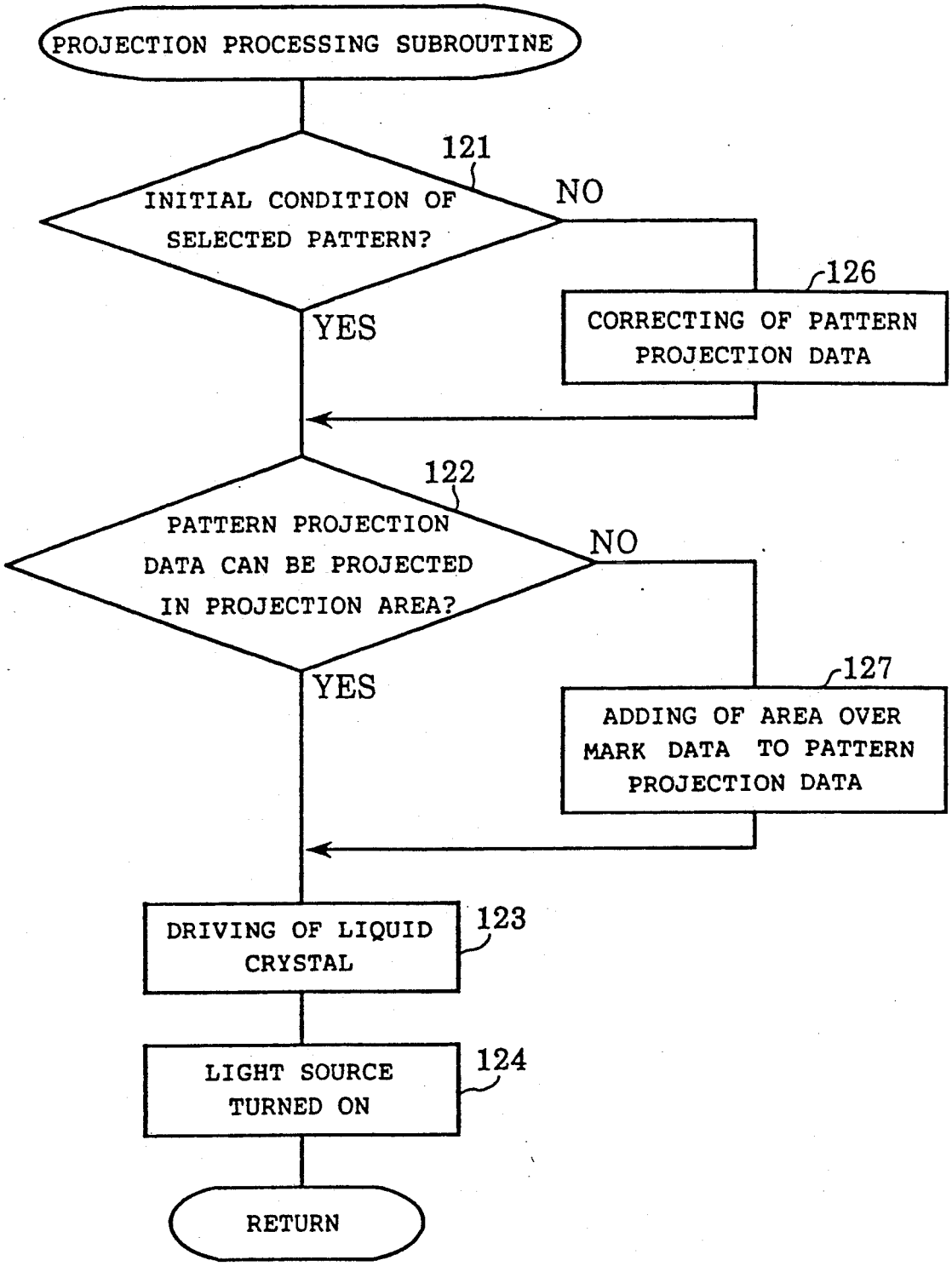
FIG. 5 is a flowchart showing a subroutine of projection processing in the projector to be used in the preferred embodiment.

FIG. 5 shows a subroutine of projection processing in the projector 56. First, it is determined in S121 whether or not the selected pattern is in an initial condition. That is, it is determined whether sewing of a new stitch pattern is started or sewing of the previous stitch pattern interrupted is restarted. If the answer in S121 is NO, the program proceeds to S126 in which the pattern projection data 80 is corrected according to the pattern stitch data 78 in the ROM 76 and the stitch number data indicative of the timing of interruption of the sewing which data has been stored into the RAM 82. This correction makes a change in position of the pattern to be projected by the projector 56 by an amount of feed of the work fabric by the feed dog 42 prior to interruption of the sewing. On the other hand, if the answer in S121 is YES, the program proceeds to S122 in which it is determined whether or not the pattern projection data 80 can be projected in a projection area 84 which will be hereinafter described with reference to FIG. 6. If the answer in S122 is YES, the program proceeds to S123 in which the shutter of the liquid crystal panel 60 is driven by the driving circuit 64 according to the pattern projection data 80.

Figure 8:
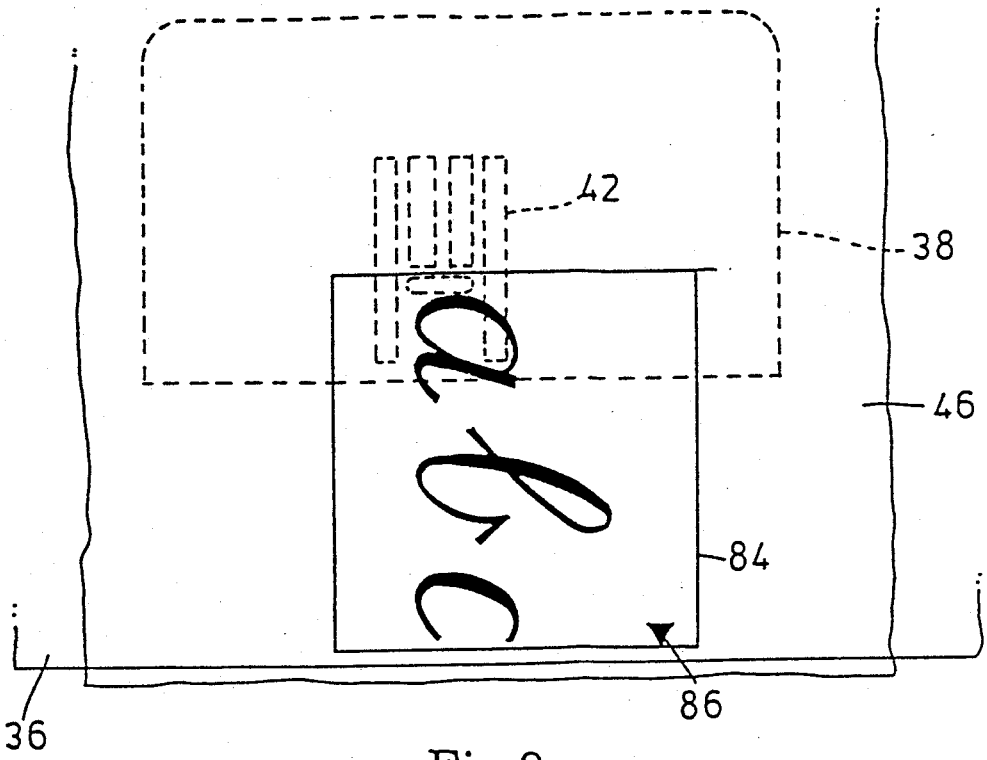
FIG. 8 is a plan view showing a condition where a combination of plural patterns is projected.

If the answer in S122 is NO, the program proceeds to S127 in which area over mark data to indicate area over mark 86, to be hereinafter described with reference to FIG. 8, is added to the pattern projection data 80, so as to indicate that a remaining part of the pattern is present outside the projection area 84. After driving the liquid crystal panel 60, the light source 58 of the projector 56 is turned on in S124, and the program is then returned.

Operation of the Preferred Embodiment

Figure 6:
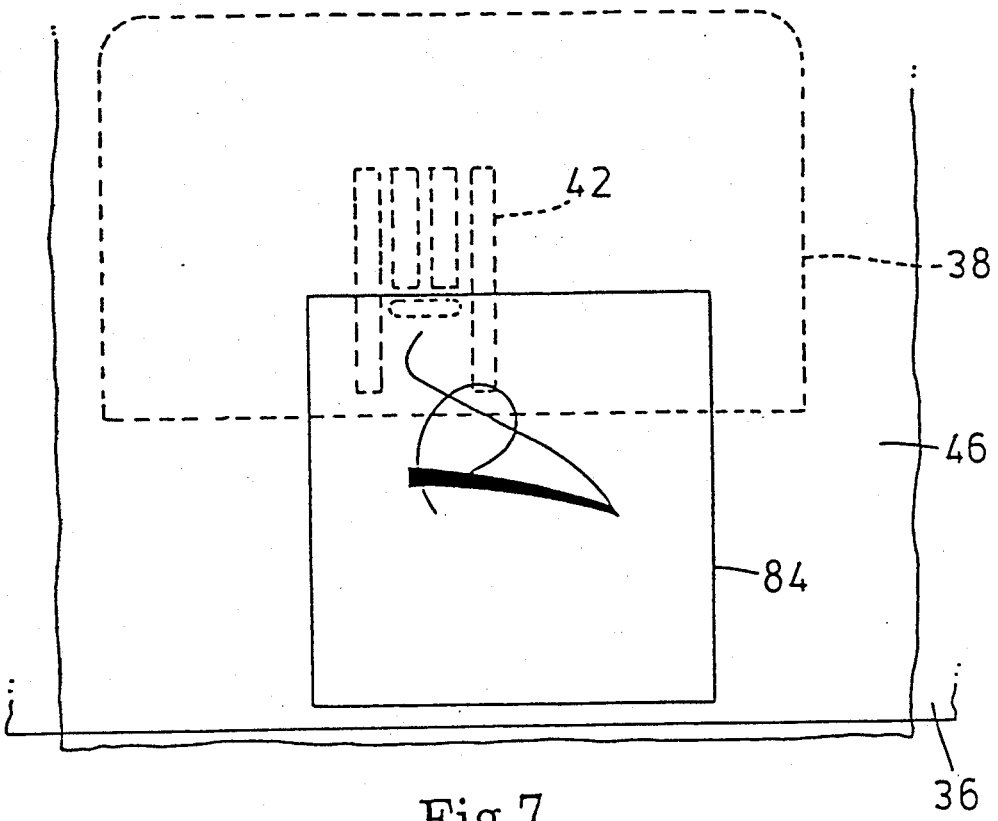
FIG. 6 is a plan view showing a condition where a selected letter is projected on a surface of a work fabric placed on a bed.

The operation of the preferred embodiment will now be described. When the operator depresses the pattern projection switch 57 under the stop condition of the sewing machine, the operation is started to turn on the projector 56 in accordance with the flowchart previously mentioned with reference to FIG. 4. FIG. 6 shows a condition where an alphabetical capital letter "A" as selected is projected by the projector 56 on the surface of the work fabric 46 placed on the bed 36. As the letter "A" is projected with the same size, direction and position as those of a stitch pattern to be obtained after sewing, the operator can easily set the work fabric at a desired position as looking at the projected pattern of the letter "A". In FIG. 6, reference numeral 84 designates a projection area where the pattern can be projected by the projector 56.

Figure 7:
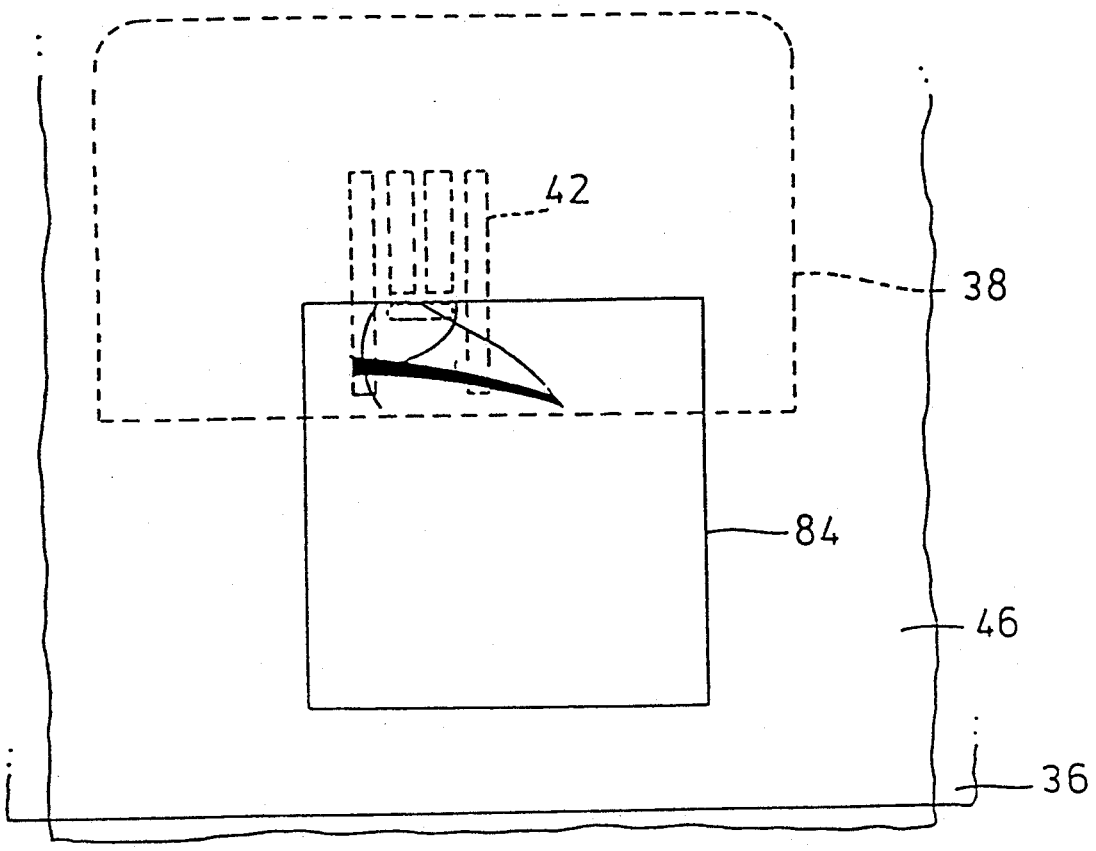
FIG. 7 is a plan view showing a condition where the operation of the sewing machine is interrupted in the course of sewing of the selected letter.

FIG. 7 shows a condition where the operation of the sewing machine 10 is stopped for any reasons in the course of sewing of the selected alphabetical letter "A". In this case, the projected pattern is corrected in X-Y directions according to the corrected pattern projection data 80. Accordingly, a part of the letter "A" outside the projection area 84 of the projector 56 is not projected.

FIG. 8 shows a condition where a combination of various patterns, e.g., alphabetical small letters "a, b, c, . . . " is selected, and a part of the combination is projected on the work fabric 46 placed on the bed 36. In such a case where the combination of plural patterns is selected, and all the patterns cannot be projected in the projection area 84, a part of the combination is projected in the projection area 84 at the maximum, and an area over mark 86 indicating that the remaining part of the combination is present outside the projection area 84 is also projected in the projection area 84. Accordingly, the operator can easily determine whether or not the remaining part of the combination of the plural letters, "a, b, c, ..." is present outside the projection area 84 according to the area over mark 86.

Figure 9:
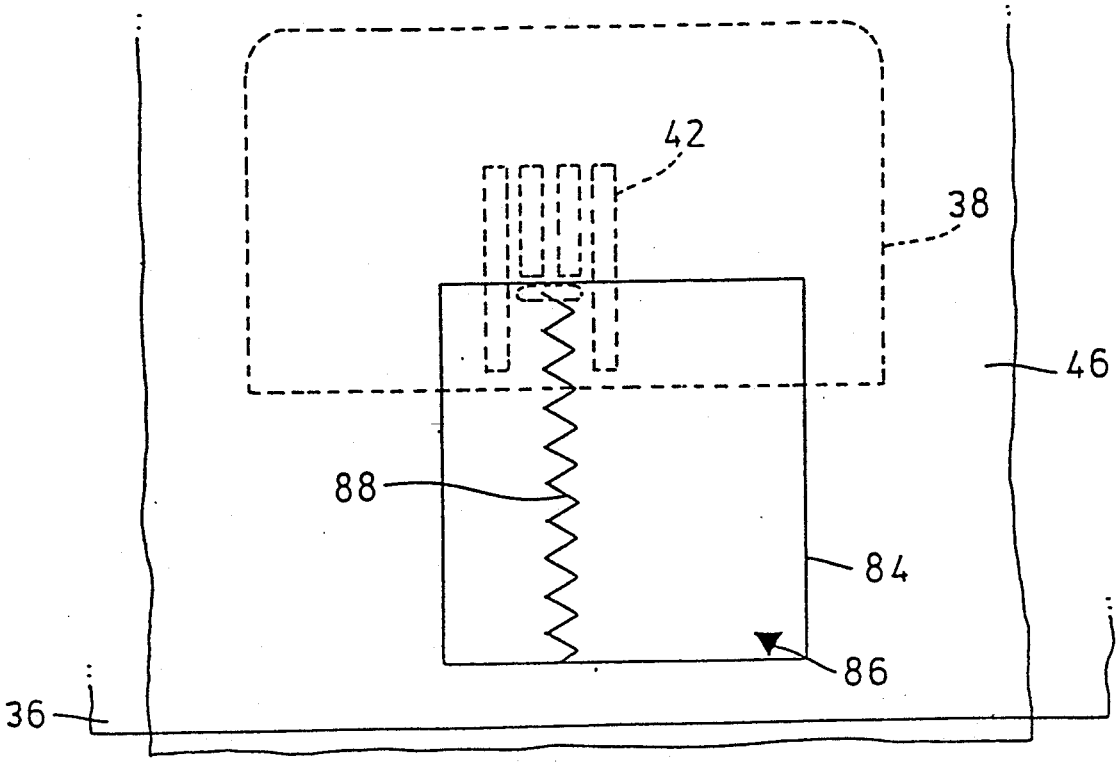
FIG. 9 is a plan view showing a condition where a zigzag continuous pattern is projected, and an area over mark indicating that the pattern is continued is also projected.

FIG. 9 shows a condition where a zigzag continuous pattern 88 is projected. In this case, as the pattern 88 is present also outside the projection area 84, the area over mark 86 is projected to indicate that the pattern 88 is continued.

It is to be understood that the present invention is not limited to the foregoing preferred embodiment but various modifications may be made without departing from the spirit of the invention. For instance, the sewing machine may be provided with a function such that a size of various stitch patterns to be sewn can be changed by a manual operation of the operator, and a size of patterns to be projected can be also changed in accordance with the change in the size of the stitch patterns. Further, a program pattern such that a desired pattern stitch data can be inputted by the operator may be added. That is, a pattern projection data corresponding to the inputted pattern stitch data may be computed in the control device 66 and temporarily stored in the RAM 82, so that the pattern projection data thus created may be projected by the projector 56. Further, although the projector 56 employs the liquid crystal panel 60 in the above preferred embodiment, any other projectors employing a laser beam or a slide film may be used.

Further, although the projector 56 is applied to the zigzag sewing machine 10 in the above preferred embodiment, it may be applied to an embroidery sewing machine wherein the needle 30 is vertically reciprocated, and the work fabric 46 is moved in a horizontal plane to sew various patterns. That is, the present invention can be applied to all the sewing machines wherein the needle bar 28 and the work fabric 46 are relatively moved in directions crossing an axis of vertical movement of the needle 30 to sew various patterns on the work fabric 46.

What is claimed is:

1. In a sewing machine including a frame, a needle bar having a needle at the lower end thereof and vertically movably supported by the frame, and a memory storing data relating to various patterns, wherein said needle bar and a work fabric are relatively moved in directions crossing an axis of vertical movement of the needle according to said data read from the memory to sew a pattern on the work fabric; the improvement comprising:

means for providing image data relative to a pattern selectively read from the memory; and means responsive to said image data for projecting a pattern onto a surface of a bed of said sewing machine or the work fabric on the bed, said projecting means disposed on the frame near the needle bar, a pattern to be projected by said projecting means having the same size, direction and position as a stitch pattern to be obtained after sewing.

2. Apparatus as in claim 1, further comprising:

means for determining if the needle bar is reciprocating; and means for enabling operation of the projecting means upon the occurrence of a negative determination by said determining means.

3. Apparatus as in claim 1, further comprising:

means for determining if the needle bar is reciprocating, and means for disabling operation of the projecting means in response to a positive determination by the determining means.

4. Apparatus as in claim 3, further comprising:

manually operable means for placing the projecting means in a operative state.

5. A sewing machine comprising:

a needle;

means for reciprocating said needle;

means for feeding a fabric in a path transverse to the axis of reciprocation of said needle;

means for coordinating movement of said needle and said feeding means to produce a stitch pattern on the fabric;

means for forming an image, in an image area, of a stitch pattern to be produced, on the fabric;

means for determining if said needle is reciprocating; and means for enabling operation of said image forming means upon the occurrence of a negative determination by said determining means.

6. Apparatus as in claim 5, wherein the image forming means includes means for optically projecting said image on the fabric.

7. Apparatus as in claim 5, comprising:

means for storing a plurality of predetermined patterns to be sewn; and means for controlling the coordinating means and the image forming means in accordance with one of said predetermined patterns.

8. Apparatus as in claim 7, comprising means for laterally moving the needle with respect to the feed path of the fabric; and said coordinating means includes means for coordinating the moving means, the reciprocating means and the feeding means to produce a sewn pattern.

9. Apparatus as in claim 6, wherein the image projecting means comprises:

a light source; and changeable pattern forming means through which light from the light source is transmitted.

10. Apparatus as in claim 5, wherein the image formed by the image forming means corresponds in size and shape to the pattern to be sewn on the fabric.

11. Apparatus as in claim 5, comprising:

means for determining if a complete pattern has been sewn when sewing of the pattern is stopped; and means for storing information relative to the completed portion of the pattern when sewing is stopped before completion of sewing of the pattern.

12. Apparatus as in claim comprising means for providing information from the storing means to the coordinating means for effecting completion of a previously partially completed pattern.

13. Apparatus as in claim 5, comprising:

means for determining if the pattern to be formed falls within the image area, and means for indicating that a portion of the pattern is outside said image area.

14. Apparatus as in claim 13, wherein said indicating means comprises means for generating a mark.

15. Apparatus as in claim 14, wherein image forming means comprises means for projecting the pattern on the fabric and wherein the projecting means includes means for projecting said mark.

16. Apparatus as in claim 15, wherein the projecting means comprises a light source for directing light onto the fabric; and means interposed between the light source and the fabric for forming a light transmissible image through which light from the light source passes.

17. Apparatus as in claim 16, wherein the means for forming the light transmissible image is a liquid crystal element.

18. Apparatus as in claim 17, comprising:

means for storing data relating to a plurality of patterns;

means for providing pattern data stored in the storing means to the coordinating means to effect sewing of a pattern; and means for supplying pattern data corresponding to the pattern data provided by the storing means to coordinating means to the liquid crystal element.

19. Apparatus as in claim 18, wherein the projecting means projects an image of a desired pattern on the fabric in the same size and orientation as the pattern to be sewn on the fabric.

20. A sewing machine comprising:

a reciprocable needle bar having a needle at the lower end thereof;

means for reciprocating the needle bar;

means for feeding fabric in a path transverse to the axis of reciprocation of the needle bar;

means for moving the needle bar laterally with respect to the feed path of the fabric as the needle bar reciprocates;

pattern storing means for storing pattern data for a plurality of patterns to be sewn;

control means for controlling the needle bar reciprocating means, the needle bar moving means and the fabric feeding means to sew a pattern on the fabric in accordance with pattern data stored in the pattern storing means;

image storing means for storing image data corresponding to the patterns stored in the pattern storing means; and means for forming an image of a pattern on the fabric based on image data stored in the image storing means, the image forming means disposed adjacent to the needle bar.

21. Apparatus as in claim 20, wherein the image forming means comprises means for projecting images of said patterns on the fabric.

22. Apparatus as in claim 21, wherein the image forming means comprises a light transmissible image element and means for irradiating the fabric through the light transmissible image element.

23. Apparatus as in claim 22, wherein the light transmissible element is a liquid crystal.

24. Apparatus as in claim 20, comprising:

means for storing pattern completion data corresponding to the portion of a pattern being sewn;

means for determining if the pattern completion data in the pattern completion storage means defines a completed pattern; and means for effecting completion of sewing of a pattern based on a determination by the determining means that the sewn pattern is incomplete.

25. Apparatus as in claim 24, wherein the pattern completion effecting means is operative after an interruption in the sewing of said pattern.

26. Apparatus as in claim 25, wherein the image forming means includes means for receiving data from the pattern completion storage means and forming an image on the fabric corresponding to the portion of the pattern to be completed.

27. Apparatus according to claim 20, comprising:

means for defining a pattern image area;

means for determining if the pattern image to be formed is within the pattern image area; and means for indicating that a portion of the pattern image is outside the pattern image area.

* * * * *